US010549938B2

(12) United States Patent
Chow et al.

(10) Patent No.: US 10,549,938 B2
(45) Date of Patent: Feb. 4, 2020

(54) MEDIA UNIT REDIRECTOR ASSEMBLY FOR MEDIA PROCESSING DEVICES

(71) Applicant: Zebra Technologies Corporation, Lincolnshire, IL (US)

(72) Inventors: Steve Ting Kei Chow, Monterey Park, CA (US); David G. Guillouche, Sylmar, CA (US); Raymond E. Maynard, Westerly, RI (US)

(73) Assignee: Zebra Technologies Corporation, Lincolnshire, IL (US)

( * ) Notice: Subject to any disclaimer, the term of this patent is extended or adjusted under 35 U.S.C. 154(b) by 0 days.

(21) Appl. No.: 16/229,427

(22) Filed: Dec. 21, 2018

(65) Prior Publication Data

US 2019/0144226 A1 May 16, 2019

Related U.S. Application Data

(63) Continuation of application No. 15/644,017, filed on Jul. 7, 2017, now abandoned.

(51) Int. Cl.

| | |
|---|---|
| ***B65H 9/10*** | (2006.01) |
| ***B65H 85/00*** | (2006.01) |
| ***B65H 15/00*** | (2006.01) |

(52) U.S. Cl.

CPC ..... *B65H 9/101* (2013.01); *B65H 15/00* (2013.01); *B65H 85/00* (2013.01); *B65H 2301/332* (2013.01); *B65H 2301/3321* (2013.01); *B65H 2301/33212* (2013.01); *B65H 2301/33214* (2013.01); *B65H 2301/33224* (2013.01); *B65H 2403/942* (2013.01);

(Continued)

(58) Field of Classification Search

CPC .. B65H 15/00; B65H 15/02; B65H 2301/133; B65H 2301/332; B65H 2301/3321; B65H 2301/33212; B65H 2301/33214; B65H 2301/3322; B65H 2301/33222; B65H 2301/33224; B65H 2403/942; B65H 2404/1521; B65H 2404/15212; B65H 2701/1914; B65H 2404/1421; B65H 9/06; B65H 9/101

See application file for complete search history.

(56) References Cited

U.S. PATENT DOCUMENTS 8,276,734 B2 * 10/2012 Nago ..... B65H 9/101 194/293
8,371,580 B2 * 2/2013 Nireki ..... B65H 5/062 271/245

(Continued)

*Primary Examiner* — Jeremy R Severson

(57) ABSTRACT

Disclosed is an example of a registration assembly for a media processing device, including a registration surface. The registration assembly including a bias member coupled to the registration surface to bias the registration surface toward the media processing path to apply a force to a media unit. The registration assembly including an activator coupled to a roller, the roller to be driven via contact with the media unit. The activator configured to move the registration surface toward the media processing path into the active position to engage the media unit responsive to rotation of the roller in the first rotational direction. The activator configured to move the registration surface away from the media processing path into an inactive position responsive to rotation of the roller in the second rotational direction.

16 Claims, 12 Drawing Sheets

(52) U.S. Cl.
CPC ..... *B65H 2404/1521* (2013.01); *B65H 2404/15212* (2013.01); *B65H 2701/1914* (2013.01)

(56) References Cited

U.S. PATENT DOCUMENTS 9,399,359 B2 * 7/2016 Masunaga ..... B41J 13/009
9,926,153 B2 * 3/2018 Kubota ..... B65H 7/02

* cited by examiner

MEDIA UNIT REDIRECTOR ASSEMBLY FOR MEDIA PROCESSING DEVICES

CROSS REFERENCE TO RELATED APPLICATIONS

This patent arises from a continuation of U.S. patent application Ser. No. 15/644,017, filed Jul. 7, 2017, which is hereby incorporated herein by reference in its entirety.

BACKGROUND

Media processing devices configured to process discrete media units, such as card printers configured to print identity cards, may be required to process both sides of a media unit. Such media processing devices may therefore include components configured to flip the media unit over when one side has been processed, to permit processing of the opposite side. The above-mentioned components may lead to increased complexity or interrupted operation of the media processing device.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
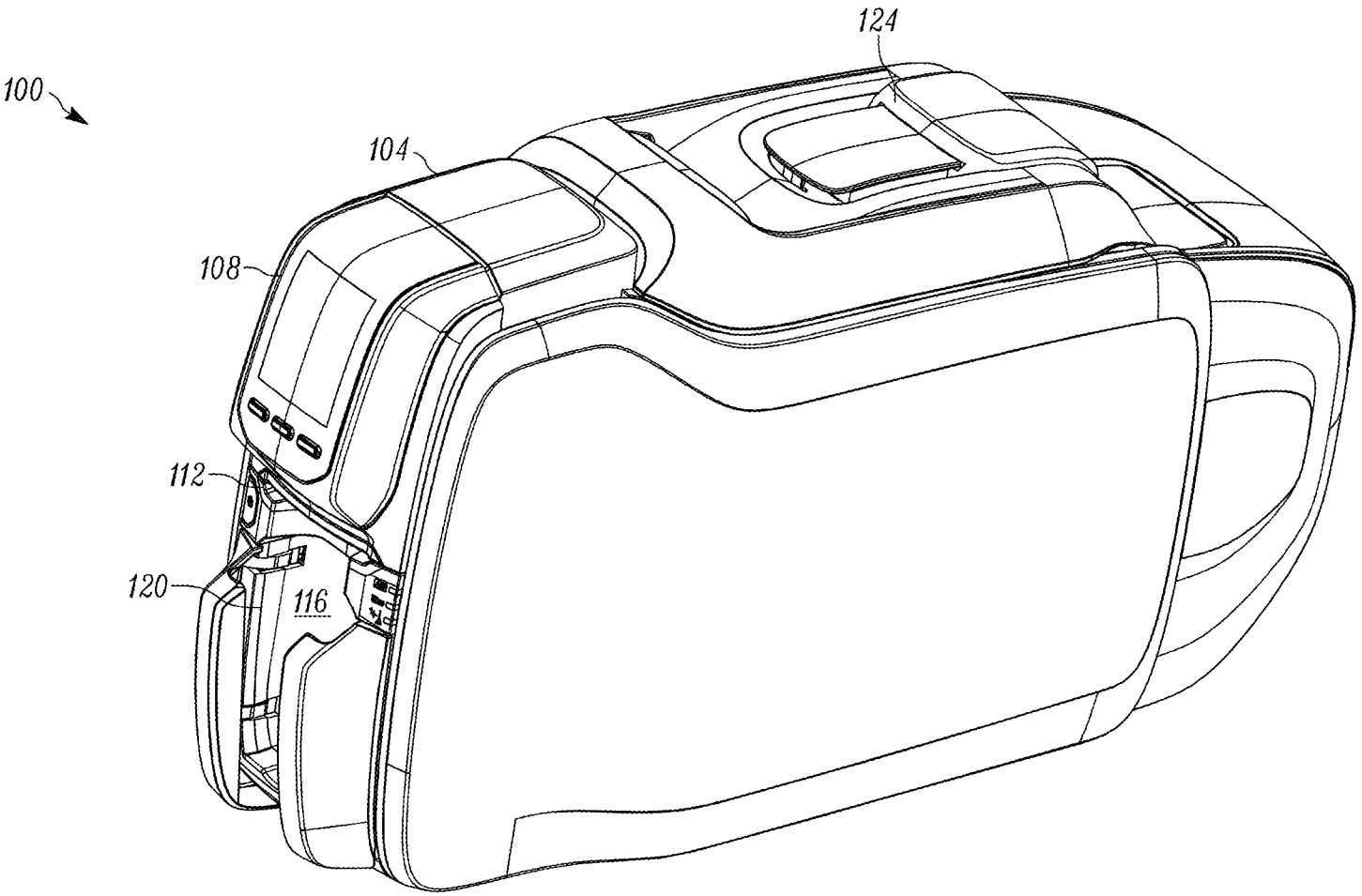
FIG. 1 depicts an example media processing device.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding embodiments of the apparatus and methods disclosed herein so as not to obscure the disclosure with details that will be readily apparent to those of ordinary skill in the art having the benefit of the description herein.

DETAILED DESCRIPTION

Some media processing devices are configured to process discrete media units, such as identity cards (e.g., driver's licenses or employee badges). Some examples disclosed herein are described using the term "cards." However, cards are example discrete media units and example methods and apparatus disclosed herein are applicable to any suitable type of discrete media unit(s).

Some media units, such as the above-mentioned cards, are printed on both sides. In such cases, rather than include distinct printheads disposed on either side of the media unit, media processing devices typically include a mechanism for receiving a media unit after the first side has been processed at the printhead, and flipping the media unit over to expose the opposite side of the media unit to the printhead on a return pass of the printhead.

The above-mentioned mechanism typically includes at least a first motor to receive the media unit into the mechanism and expel the media unit from the mechanism after flipping, and a second motor to flip the card over (e.g., by rotating a portion of the mechanism following receipt of the media unit therein). The inclusion of two motors and associated components (e.g., drivetrain components, power delivery for the motors, and the like) increases the complexity of the media processing device. In turn, the increased complexity may lead to increased manufacturing cost. Further, the increased complexity may leave the media processing device vulnerable to a higher incidence of mechanical failure.

Example methods and apparatus disclosed herein provide media processing devices with a media unit redirector configured to receive a media unit, for instance after one side of the media unit has been processed at a printhead, and to flip the media unit before ejecting the media unit for processing of an opposite side of the media unit at the printhead. Further, example methods and apparatus disclosed herein permit the above-mentioned redirector to perform both the receipt and ejection of the media unit, and the flipping of the media unit, while driven by a single power source, such as a motor.

Some example apparatus disclosed herein are directed to a media processing device having a housing, the media processing device comprising: a media unit transport assembly configured to guide a media unit (i) from an unprocessed media unit source to traverse a media processing head in an outbound direction, and (ii) to traverse the media processing head in a return direction toward a processed media unit output; a media unit redirector configured to receive the media unit in the outbound direction, flip the media unit, and expel the media unit in the return direction, the media unit redirector including: a motor having an output shaft; a redirector carriage rotatably supported by the housing; a roller rotatably supported by the carriage for engaging with the media unit; and a selector supported by the carriage and connected between the output shaft and the roller; the selector configured, (i) responsive to a first output shaft drive direction, to rotate relative to the carriage and drive the roller for receiving or expelling the media unit, and (ii) responsive to a second output shaft drive direction, to engage the carriage and rotate the carriage relative to the housing for flipping the media unit.

FIG. 1 depicts an example media processing device 100 constructed in accordance with the teachings of this disclosure. The media processing device 100 includes a housing 104 defined by a plurality of panels. The media processing device 100 stores a supply of discrete media units, such as cards (e.g. identity cards) in an unprocessed media source. In this example, the unprocessed media source is an input hopper (not shown) within the housing 104 and accessible from the exterior of the media processing device 100 via an input hopper door 108. The media processing device 100 also includes an auxiliary input slot 112 for insertion of single media units into the input hopper. The media processing device 100 generates indicia on a media unit from the input hopper before dispensing the media unit into a processed media output. In this example, the processed media output is an output hopper 116 accessible via an output opening 120. The indicia applied to the media units by the media processing device 100 are sourced from a cassette (e.g. a ribbon cassette) supported within the housing 104 and accessible from the exterior of the media processing device 100 via a cassette access door 124. In some examples, the access door 124 includes a lock to prevent unauthorized access to the interior of the media processing device 100 and, as described below, rejected media units. Notably, the output opening 120 associated with processed media (i.e., non-rejected cards) is separate from the reject area described in detail below.

Figure 2:
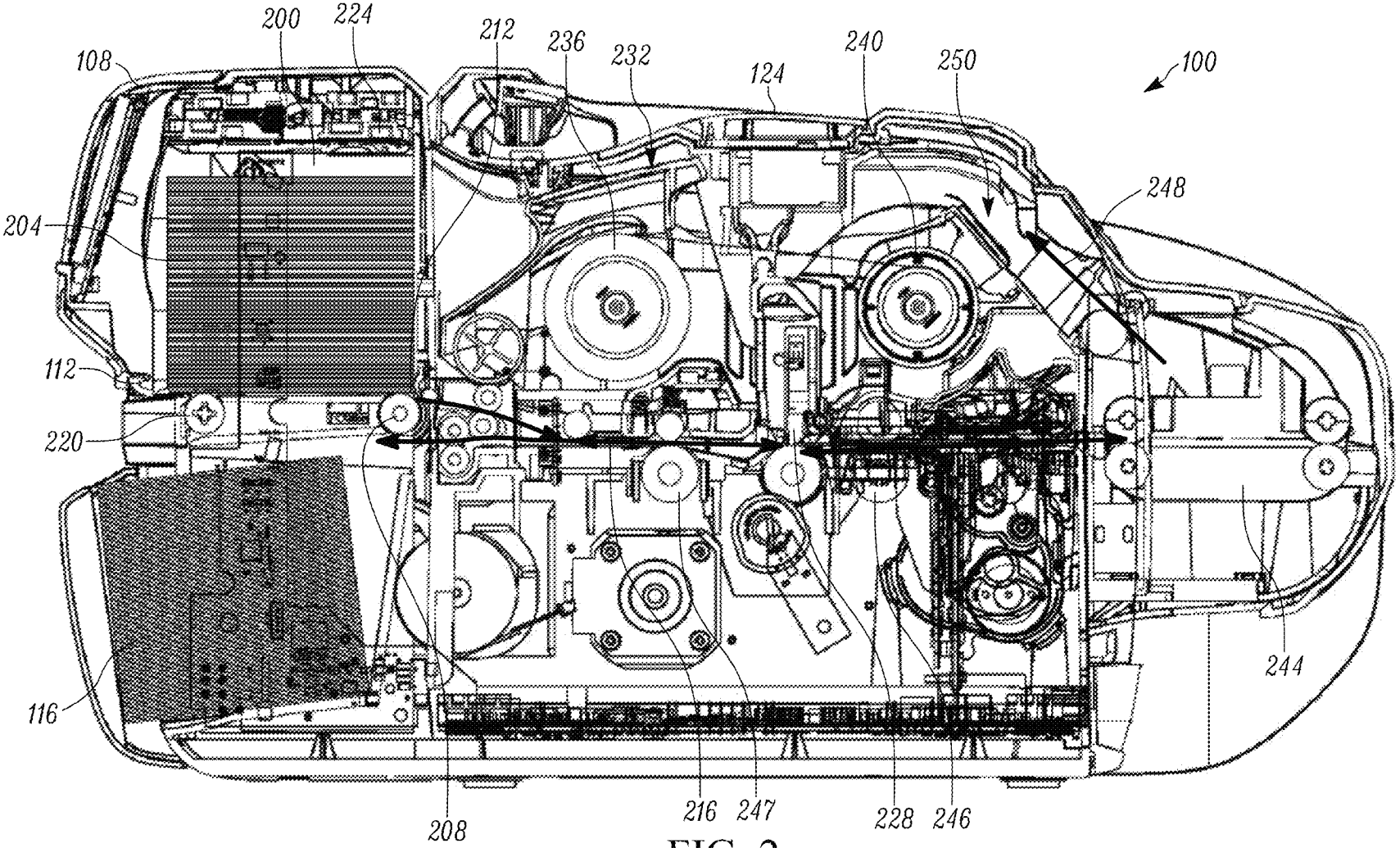
FIG. 2 depicts a cross-sectional view of the media processing device of FIG. 1.

Turning to FIG. 2, a cross-sectional view of the example media processing device 100 of FIG. 1 is depicted. As seen in FIG. 2, the media processing device 100 includes, within the housing 104, an unprocessed media input in the form of an input hopper 200. The input hopper 200 is configured to store a plurality of discrete media units 204, such as identity cards, in a substantially horizontal stack. The input hopper 200 may contain media units 204 of a variety of thicknesses. For example, each media unit 204 has a thickness of between about 0.2 mm and about 1 mm. Typically, the entire supply of media units 204 in the input hopper 200 at a given time have the same thickness. However, in some examples the media processing device 100 is also configured to process a set of media units 204 having a plurality of different thicknesses.

A pick roller 208 is disposed at an outlet 212 of the input hopper 200, and is configured to dispense a single media unit 204 from the input hopper 200 to a media transport assembly configured to guide the media unit 204 along a media processing path 216. The media processing device 100 also includes an input roller 220 at the slot 112, configured to drive a single media unit fed into the slot 112 underneath the stack of media units 204 already present (if any) in the input hopper. The single media unit fed into the slot 112 is then dispensed from the input hopper 200 for travel along the media processing path 216. In other words, the media processing device 100 is configured to process media units retrieved from the stack in the input hopper 200, as well as single-feed media units received via the input slot 112.

The input hopper 200 also contains a biasing assembly 224 disposed above the stack of media units 204. The pick roller 208 dispenses the bottom media unit from the stack of media units 204 by frictionally engaging with the bottom media unit 204. If insufficient force is exerted by the bottom media unit on the pick roller 208, the frictional engagement between the pick roller 208 and the media unit may be too weak for the pick roller 208 to dispense the media unit 204. When the input hopper 200 is full, the weight of the stack of media units 204 alone may apply sufficient force for engagement between the bottom media unit and the pick roller 208. The biasing assembly 224 is configured to apply a progressively greater force to the top of the stack of media units 204 as the stack shrinks in size, thus maintaining a substantially constant force on the bottom media unit. The biasing assembly 224, in the present example, is implemented as a Sarrus linkage biased towards an open position in which the biasing assembly 224 applies a force on the media units 204 (the linkage is shown in a closed, or retracted, position in FIG. 2) by one or more biasing elements, such as a combination of coil springs.

The media transport assembly includes a plurality of rollers and guide surfaces. The media processing path 216, as seen in FIG. 2, extends from the input hopper 200 to a processing head 228, such as a printhead configured to apply indicia to the media unit 204 by transferring ink to the media unit 204. In this example, the media processing device 100 is a thermal transfer printer, and the printhead 228 is supplied with ink from a cassette 232 removably supported within the housing 104. The housing 104 includes an opening (not shown in FIG. 2) permitting access to the cassette 232. The above-mentioned cassette access door 124 has a closed position (shown in FIG. 2) for obstructing the opening to prevent access to the cassette 232, and an open position for permitting placement and removal of the cassette 232 into and out of the media processing device 100.

During printing operations, an ink ribbon (not shown) travels from a supply roller 236 of the cassette 232 to the printhead 228, and then to a take-up roller 240 of the cassette 232. As the ink ribbon and the media unit 204 pass the printhead 228, the ink ribbon is in contact with the media unit 204. To generate the above-mentioned indicia, certain elements (e.g., printhead dots) of the printhead 228 are selectively energized (e.g., heated) according to machine-readable instructions (e.g., print line data or a bitmap). When energized, the elements of the printhead 228 apply energy (e.g., heat) to the ribbon to transfer ink to specific portions of the media unit 204.

In some examples, processing of the media unit 204 also includes encoding data in an integrated circuit, such as a radio frequency identification (RFID) tag, magnetic strip, or combination thereof, embedded in the media unit 204. Such processing may occur at the printhead 228 mentioned above, or at a distinct secondary processing head upstream or downstream of the printhead 228 along the media processing path 216.

Having traversed the printhead 228, the media unit 204 is transported along the media processing path 216 to the output hopper 116. In the present example, prior to arriving at the output hopper 116, however, the media unit 204 is transported to a media unit redirector 244 controllable to reverse, or flip, the media unit 204 by receiving the media unit 204, rotating by about 180 degrees, and expelling the media unit 204. As will be discussed in greater detail below, the redirector 244 is configured to perform the above functions (receiving, flipping, and expelling a media unit 204) under motive power supplied by a single source, such as a motor.

Accordingly, the media transport assembly is configured to operate in two opposite directions along at least a portion of the media processing path 216 (illustrated in double lines). Specifically, the media processing path 216 proceeds in a return direction (as opposed to an outbound direction from the input hopper 200 to the printhead 228 and the redirector 244, described above) from the redirector 244 to the printhead 228. As a result of the media unit 204 having been flipped at the redirector 244, on the return pass of the printhead 228 an opposite side of the media unit 204 is exposed to the printhead 228 than on the outbound pass of the printhead 228. The media processing device 100, in other words, is capable of applying indicia to both sides of the media unit 204, before the media unit 204 is transported along the remainder of the media processing path 216 to the output hopper 116.

Prior to entering the redirector 244, the media unit 204 is transported by drive rollers 246 and 247 of the above-mentioned transport assembly, to traverse one or more registration assemblies, as will be discussed below. At least one of the registration assemblies is configured to align the media unit 204 with the direction of travel along the media processing path 216 before the media unit 204 enters the redirector 244. In some examples, as also discussed below, the registration assembly is configured to retract away from the media processing path 216 as the media unit 204 exits the redirector 244 in the return direction.

A media unit 204 travelling along the media processing path 216 may also be redirected from the media processing path 216 to an auxiliary processing path 248, also referred to as a media reject path. In the illustrated example, the redirector 244 is controllable, for example responsive to a detection of misaligned indicia applied at the printhead 228, a failed data writing operation to an embedded circuit in the media unit 204 or other defect, to rotate to a reject position at an angle other than 180 degrees from the resting position shown in FIG. 2. Having rotated to the reject position, the redirector 244 is configured to expel the media unit 204, which is transported along the reject path 248 to a media unit holder 250 that defines a storage area for rejected media units.

Figure 3:
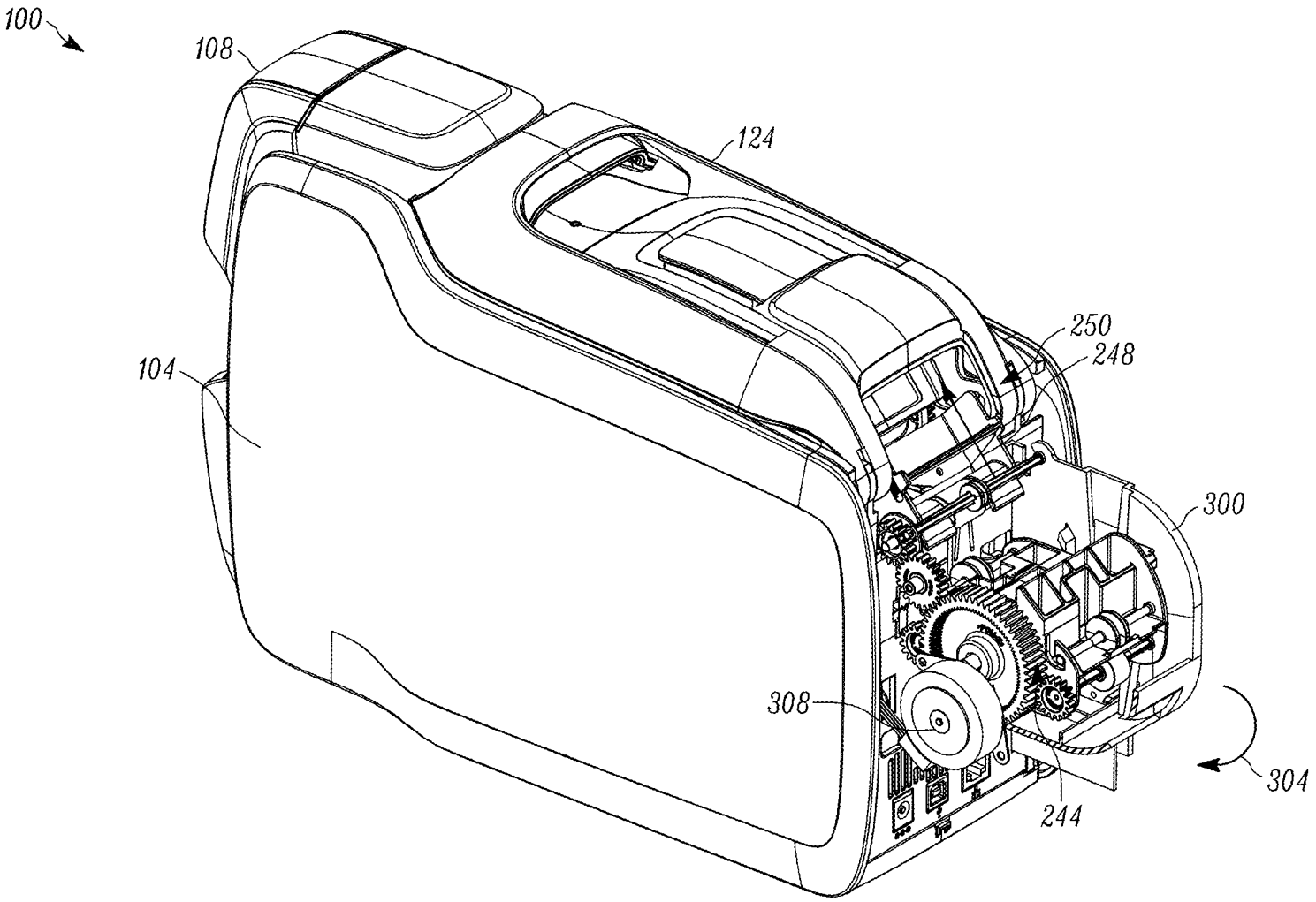
FIG. 3 is a rear perspective view of the media processing device of FIG. 1, with certain portions of the media processing device omitted.

Referring now to FIG. 3, the media processing device 100 is illustrated with certain features thereof omitted. In particular, a portion of the housing 104 enclosing the redirector 244 is omitted, and a redirector housing 300 is shown in cross-section to reveal the redirector 244. As will be discussed below, the redirector 244 is configured to receive a media unit 204 in the outbound direction, to rotate while holding the media unit 204 (e.g., in the direction 304 illustrated in FIG. 3) to flip the media unit 204 over, and to then expel the media unit 204 back toward the media processing path 216 (that is, in the return direction). When expelled from the redirector 244 in the return direction, the media unit 204 has an opposite side thereof exposed to the printhead 228. As will also be discussed herein, the redirector 244 is further configured, responsive to the detection of a defective media unit 204, to rotate (e.g., in the direction 304) until the media unit is aligned with the reject path 248 before expelling the media unit 204. Accordingly, the rejected media unit 204 is delivered to the media unit holder 250, rather than back into the media processing path 216. Having expelled the media unit 204 (whether to the media processing path 216 or the reject path 248), the redirector 244 is configured to continue rotating in the direction mentioned above until the resting position shown in FIG. 3 is resumed.

Figure 4A:
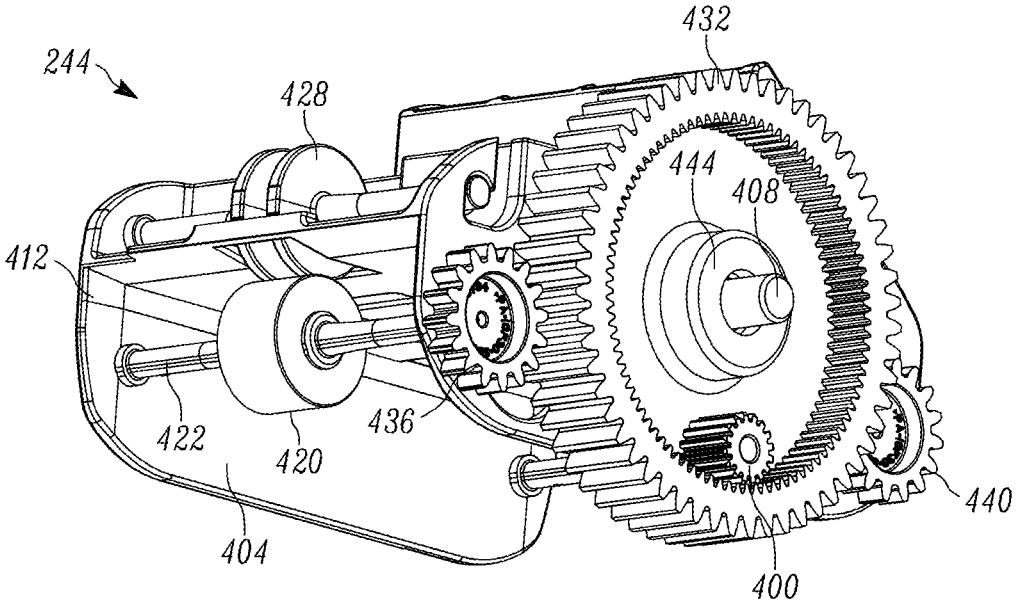
FIGS. 4A-4B depict a redirector assembly of the media processing device of FIG. 1.
Figure 4B:
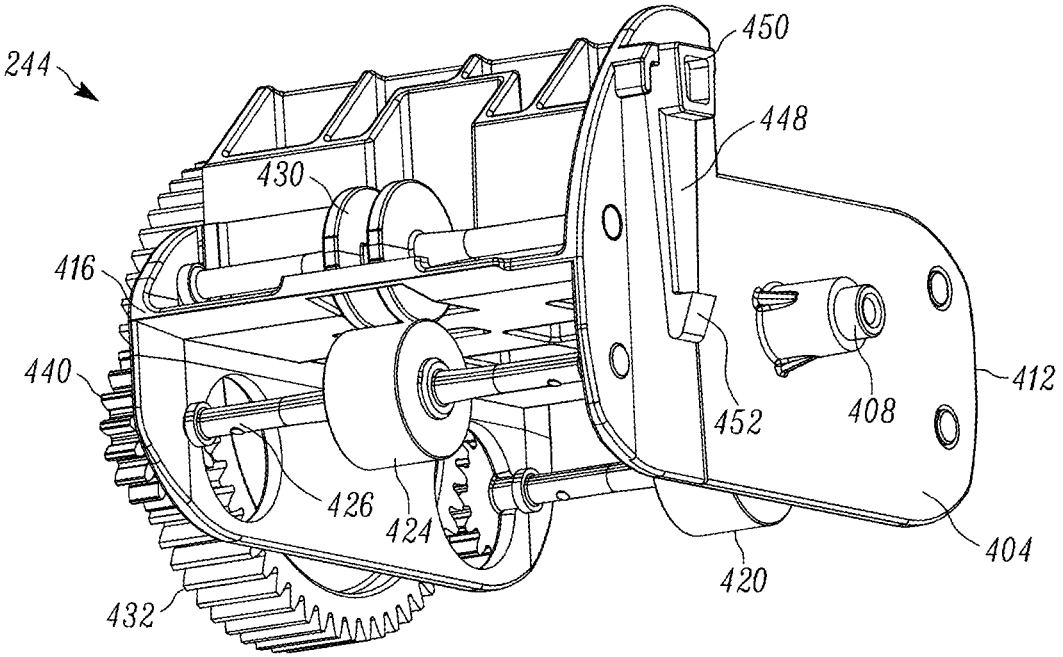

Turning to FIGS. 4A and 4B, the redirector 244 is shown in isolation. Although the motor 308 itself is omitted from FIGS. 4A-4B, an output shaft 400 driven by the motor 308 is illustrated. In the present example, the output shaft 400 includes a pinion gear mounted thereon. In other examples, the pinion gear can be replaced by a gear train, a pulley and belt drive mechanism, or the like. The redirector 244 also includes a redirector carriage 404 rotatably supported by the redirector housing 300. In the present example, the carriage 404 is rotatably supported on a shaft 408 fixed to the carriage 404, opposite ends of which are visible in FIGS. 4A and 4B. The carriage 404 includes an input end 412, for receiving media units 204, and an opposing output end 416, for expelling media units 204. That is, media units 204 travel in a single direction through the redirector 244 in the illustrated example. In other examples, as will be discussed below the redirector 244 is configured to both receive and expel a media unit from a single end of the carriage 404.

The redirector 244 includes a roller 420 rotatably supported by the carriage 404 (e.g., on a shaft 422, in the present example). The roller 420 is configured to engage a media unit 204 for receiving and/or expelling the media unit 204 into and/or out of the carriage 404. In the present example, the roller 420 is an input roller; that is, the roller 420 is supported adjacent to the input end 412 of the carriage 404. Further, in the present example, the redirector 244 also includes a second output roller 424 (adjacent the output end 416) rotatably supported by the carriage 404 on a shaft 426. In other examples, based on the length of the media unit 204, a single roller mounted centrally within the carriage 404 may serve as both input and output roller. Further, as will be discussed further below, in some examples the media unit 204 is received and expelled at the same end of the carriage 404, and the redirector 244 can therefore be provided with a single roller.

In the present example, the rollers 420 and 424 form nips with respective nip rollers 428 and 430 for engaging with the media unit 204. The rollers 420 and 424 are driven, as will be described below, while the nip rollers 428 and 430 are passive in the present example. In other examples, however, the nip rollers 428 and 430 may also be driven, e.g. by the motor 308.

The redirector 244 also includes a selector 432 supported by the carriage 404 and connected between the output shaft 400 and the roller 420. In the present example, the selector 432 is connected between the output shaft 400 and both the rollers 420 and 424. As illustrated in FIGS. 4A-4B, the connection between the selector 432 and each of the rollers 420 and 424 is implemented via engagement of gear teeth on the selector 432 with, respectively, a roller drive wheel (e.g., a gear) 436 fixed to the shaft 422, and a roller drive wheel (e.g., a gear) 440 fixed to the shaft 426. In some embodiments, additional gears or other drive wheels (e.g. belt-driven pulleys) may be inserted between the selector 432 and the shafts 422 and 426 carrying the rollers 420 and 424, respectively. As will be described below, the selector 432 is configured, responsive to driven rotation of the output shaft 400 in a first direction, to rotate relative to the carriage 404 and drive (via the engagement with the gears 436 and 440 noted above) the rollers 420 and 424 for receiving or expelling a media unit 204 from the redirector. The selector 432 is also configured, responsive to driven rotation of the output shaft 400 in a second direction opposite the first direction, to engage the carriage 404 and rotate the carriage itself on the shaft 408 relative to the redirector housing 300, to flip the media unit 204. In other words, by controlling the direction in which the motor 308 drives the output shaft 400, the selector 432 is configured to select between (i) driving a media unit 204 into or out of the redirector 244 with the rollers 420 and 424, and (ii) flipping the media unit 204 by rotating the carriage 404.

In the present example, the selector 432 is so configured by being mounted to rotate about the shaft 408 responsive to the first direction of rotation of the output shaft 400, and to engage the shaft 408 responsive to the second direction of rotation of the output shaft 400. More specifically, the selector 432 includes a drive wheel such as the gear shown in FIG. 4A, mounted on the shaft 408 via a one-way clutch 444. In the present example, the selector 432 is permitted by the clutch 444 to rotate freely about the shaft 408 in the counterclockwise direction (with reference to the orientation shown in FIG. 4A). When the selector 432 rotates about the shaft 408, the rollers 420 and 424 are driven via the engagement between the selector 432 and the gears 436 and 440.

When the selector 432 rotates in the clockwise direction (again with reference to FIG. 4A), however, the clutch 444 is configured to grip the shaft 408, preventing the selector 432 from rotating relative to the carriage 404. Therefore, clockwise rotation of the selector 432 results in clockwise rotation of the carriage 404 relative to the redirector housing 300.

In summary, returning to FIG. 3, by initiating operation of the motor 308 to rotate the output shaft 400 in the above-mentioned first direction, the redirector 244 can be controlled to drive the rollers 420 and 424 (via the selector 432) to receive a media unit 204 from the media processing path 216. By switching the direction of the motor 308 to drive the output shaft 400 in the second direction, the redirector 244 can then be controlled to rotate the carriage 404, now carrying a media unit 204, in the direction 304. Following a detection that the carriage 404 has reached the desired position (e.g., aligned with either the reject path 248 or the media processing path 216), the motor 308 is again reversed to drive the output shaft 400 in the first direction to expel the media unit 204 from the redirector 244.

The control of the motor 308 and the detection and control of redirector 244 position will now be described in further detail, according to certain examples. Still referring to FIG. 4B, the carriage 404 includes a flexible hook 448 mounted to the carriage 404 at a first end 450 thereof, permitting a second end 452 of the hook 448 to deflect relative to the carriage 404.

Figure 5A:
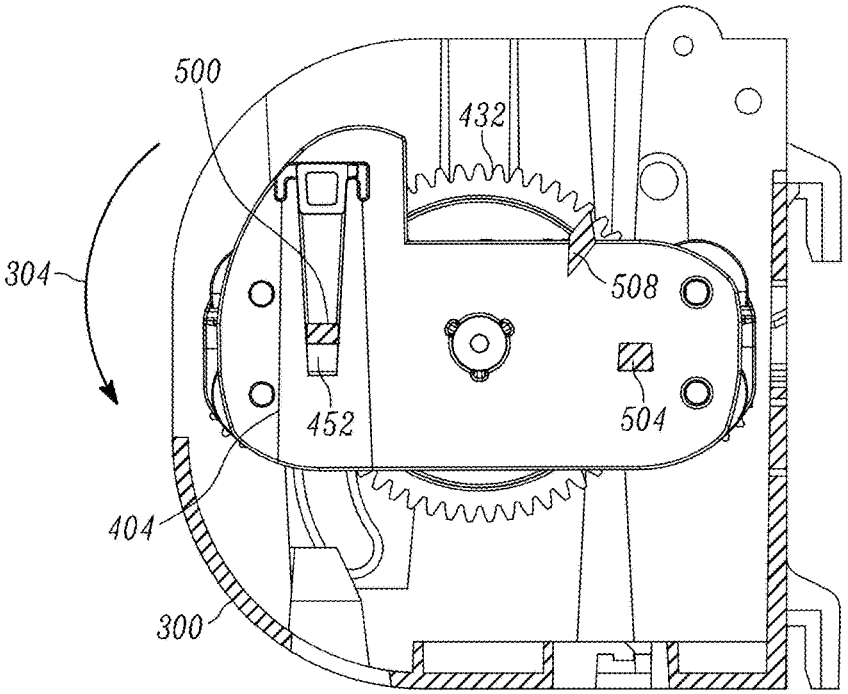
FIGS. 5A-5B and 6 depict a partial cross-section of the redirector of FIGS. 4A-4B and a housing thereof.
Figure 5B:
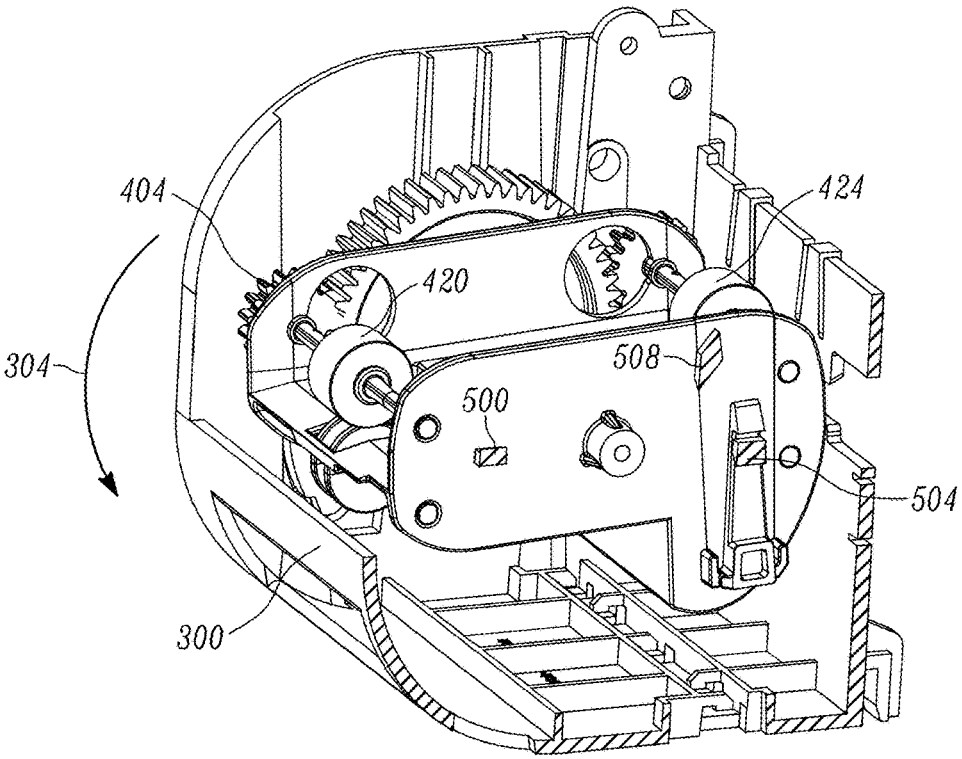

Turning to FIGS. 5A and 5B, the redirector 244 is shown as installed within the redirector housing 300, which is shown in cross section to reveal a set of stops extending from an inner wall of the redirector housing 300. In particular, a first stop 500, a second stop 504, and a third stop 508 are shown protruding from the inner wall toward the carriage 404. The second end 452 of the hook 448 is configured to deflect toward the carriage 404 upon impact with any of the stops 500, 504, 508 as the carriage 404 travels in the direction 304, but to prevent movement of the carriage 404 in the opposite direction by engaging with the stops 500, 504, 508. Although, as noted above, the selector 432 is mounted on the shaft 408 via the one-way clutch 444, the clutch 444 may not entirely prevent motion of the carriage 404 in the direction opposite to the direction 304. That is, a certain degree of force may be required before the clutch 444 permits movement of the selector 432 relative to the carriage 404 to drive the rollers 420 and 424. The stops 500, 504 and 508, in cooperation with the hook 448 provide resistance against which the motor 308 can apply the above-mentioned force to unlock the clutch 444 from the shaft 408 and begin driving the rollers 420, 424 without introducing errors in the position of the redirector 244.

Each of the stops 500, 504 and 508 correspond to an operational position of the redirector 244. In particular, the stop 500 corresponds to a resting position of the redirector 244, as shown in FIG. 5A, in which the redirector 244 is ready to receive a media unit 204 from the media processing path 216. The stop 504 corresponds to a return direction output position. As seen in FIG. 5B, when the carriage 404 has rotated in the direction 304 to carry the second end 452 of the hook 448 past the stop 504, reversal of the direction of the motor 308 serves to drive the rollers 420 and 424 to expel a media unit 204 from the redirector 244 back to the media processing path 216.

Figure 6:
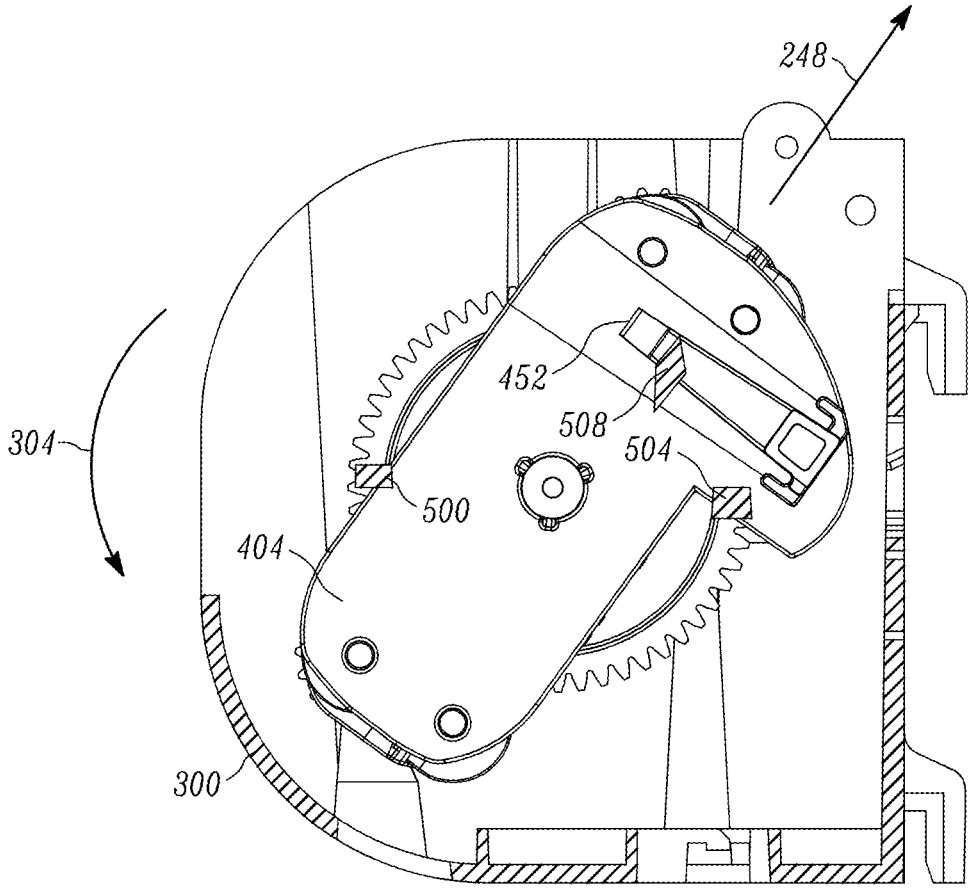

Turning to FIG. 6, the third stop 508 corresponds to a reject output position. Responsive to the carriage 404 rotating to carry the second end 452 of the hook 448 past the stop 508, reversal of the direction of the motor 308 serves to drive the rollers 420 and 424 to expel a media unit 204 from the redirector 244 to the reject path 248.

Figure 7:
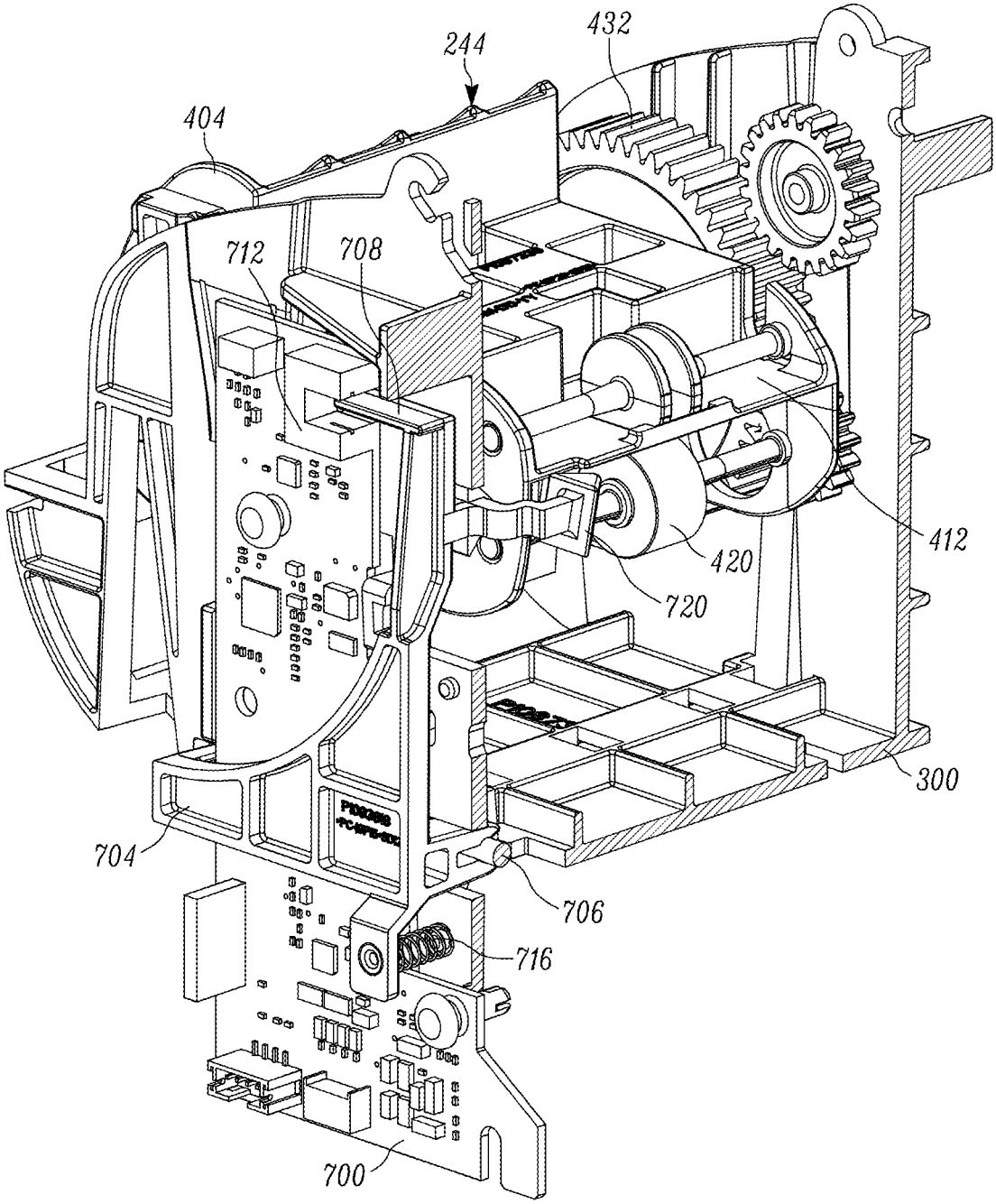
FIGS. 7 and 8 depict a further partial cross-section of the redirector of FIGS. 4A-4B and a housing thereof

The media processing device 100 also includes a controller configured to detect the position of the redirector 244, and to control the motor 308 accordingly. Turning to FIG. 7, the redirector housing 300 (shown in cross-section to cut away a wall facing the media processing path 216) supports a circuit board 700 or other support member, which carries a controller. The controller is configured, in general, to detect certain events associated with the movement of the redirector 244 and the movement of media units 204 into and out of the redirector 244, and responsive to such detections, to control the motor 308 to operate in predefined directions.

In particular, responsive to detecting the arrival of a media unit 204 at the redirector 244 in the outbound direction (that is, from the media processing path 216), the controller is configured to control the motor 308 to drive the output shaft 400 in the above-mentioned first direction for driving the rollers 420 and 424 to drive the media unit 204 into the redirector 244. The controller is configured to detect the arrival of a media unit 204 at the input end 412 of the redirector 244 via one or more sensors, including any one or more of a gap sensor, an image sensor or the like. In the present example, the redirector housing 300 movably supports a detection arm 704 mounted to pivot about a joint 706 on the housing 300. The detection arm 704 includes a flag 708 extending into a gap sensor 712 supported on the board 700. The detection arm 704 is biased, via a bias member 716 such as a spring, to maintain the flag 708 in a position that does not obstruct the gap sensor 712. The detection arm 704 also includes a strike member 720 extending into the media processing path 216. The strike member 720 is impacted by a media unit 204 arriving at the input end 412 of the carriage 404 and causes the detection arm 704 to pivot about the joint 706 against the bias member 716 to obstruct the gap sensor 712. The obstruction of the gap sensor 712 is detectable by the controller, which is then configured to operate the motor 308 in the first direction. When the media unit 204 has been fully received within the redirector 244, the strike member 720 is released from contact with the media unit 204, the detection arm 704 returns to the resting position shown in FIG. 7, and the gap defined by the gap sensor 712 is opened. In response, the controller is configured to switch the motor to operate in the second direction.

Figure 8:
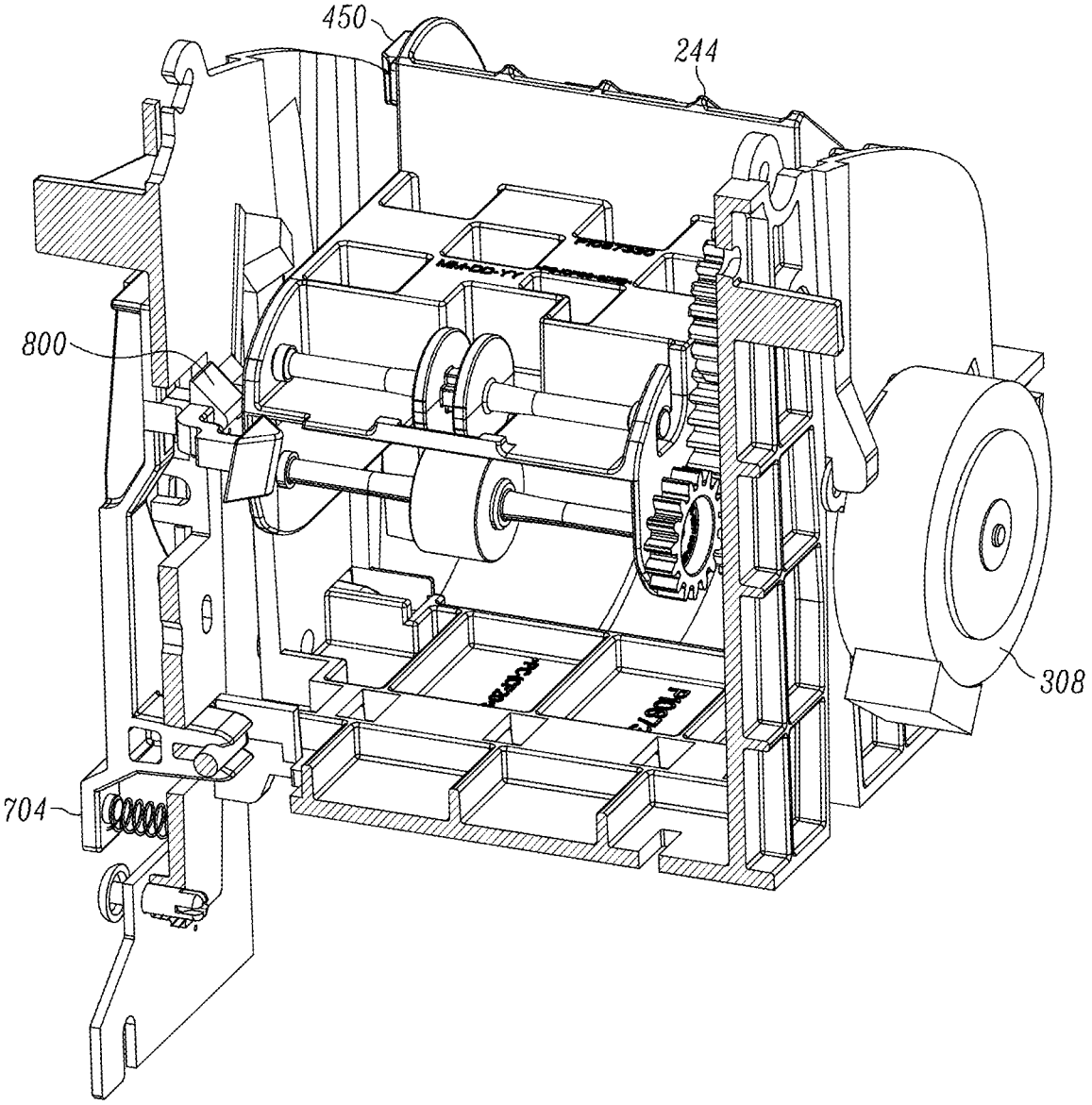

As noted earlier, when the motor 308 is operated in the second direction, the carriage 404 rotates relative to the housing 300. The controller is also configured to detect the position of the carriage 404 during such rotation. For example, turning to FIG. 8, the detection arm 704 also includes a second strike member 800 positioned to be impacted by the first end 450 of the flexible hook 448. The second strike member 800 is impacted by the second end 450 as the carriage 404 approaches the reject position shown in FIG. 6. When the second end 450 impacts the second strike member 800, the controller detects the resulting obstruction of the gap sensor 712 by the flag 708, and switches the direction of operation of the motor 308 to cease rotation of the carriage 404 and instead drive the rollers 420 and 424 to eject the media unit 204 from the redirector 244. The detection arm 704 can include additional strike members (not shown) to enable detection that the carriage 404 has reached each of the return direction output position and the resting, or input, position.

Figure 9A:
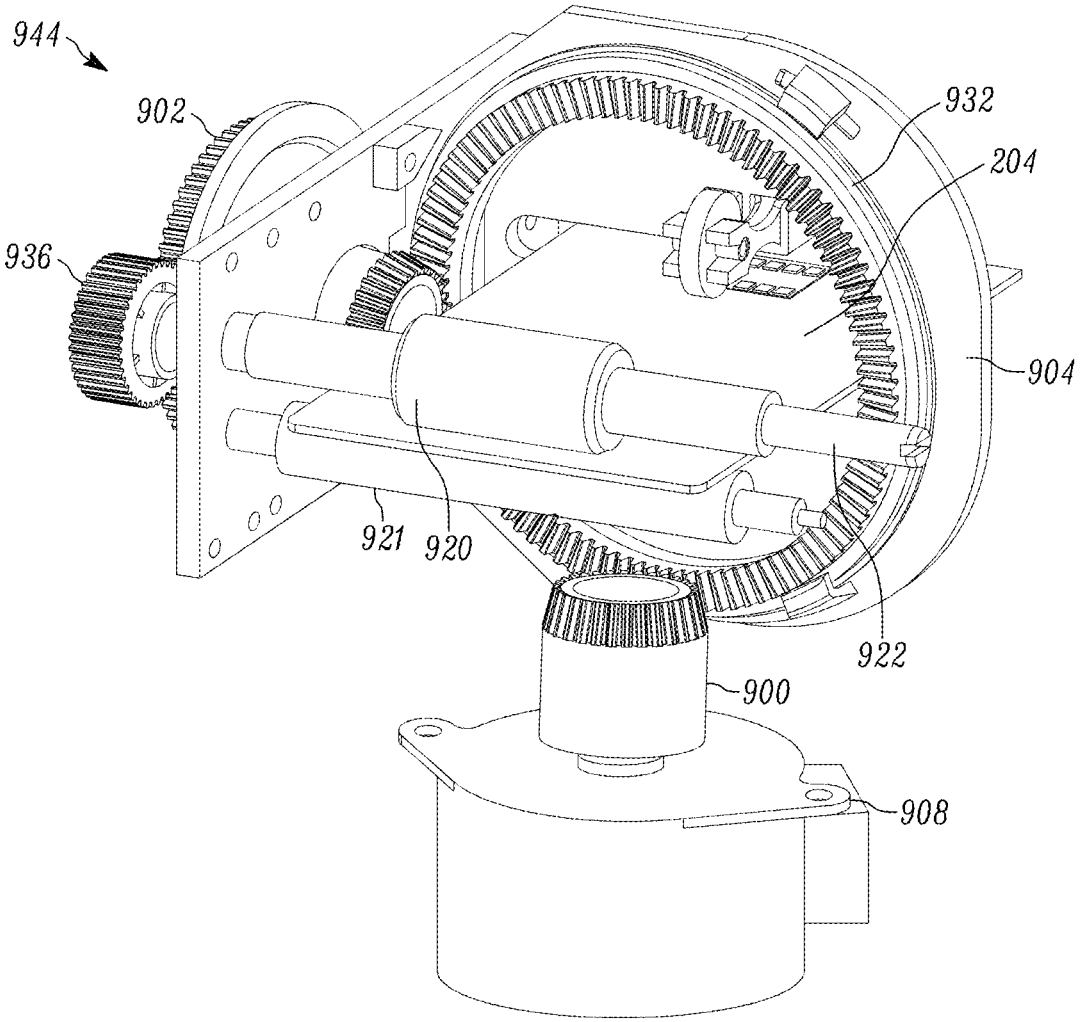
FIGS. 9A-9B depict a further example of a redirector assembly.
Figure 9B:
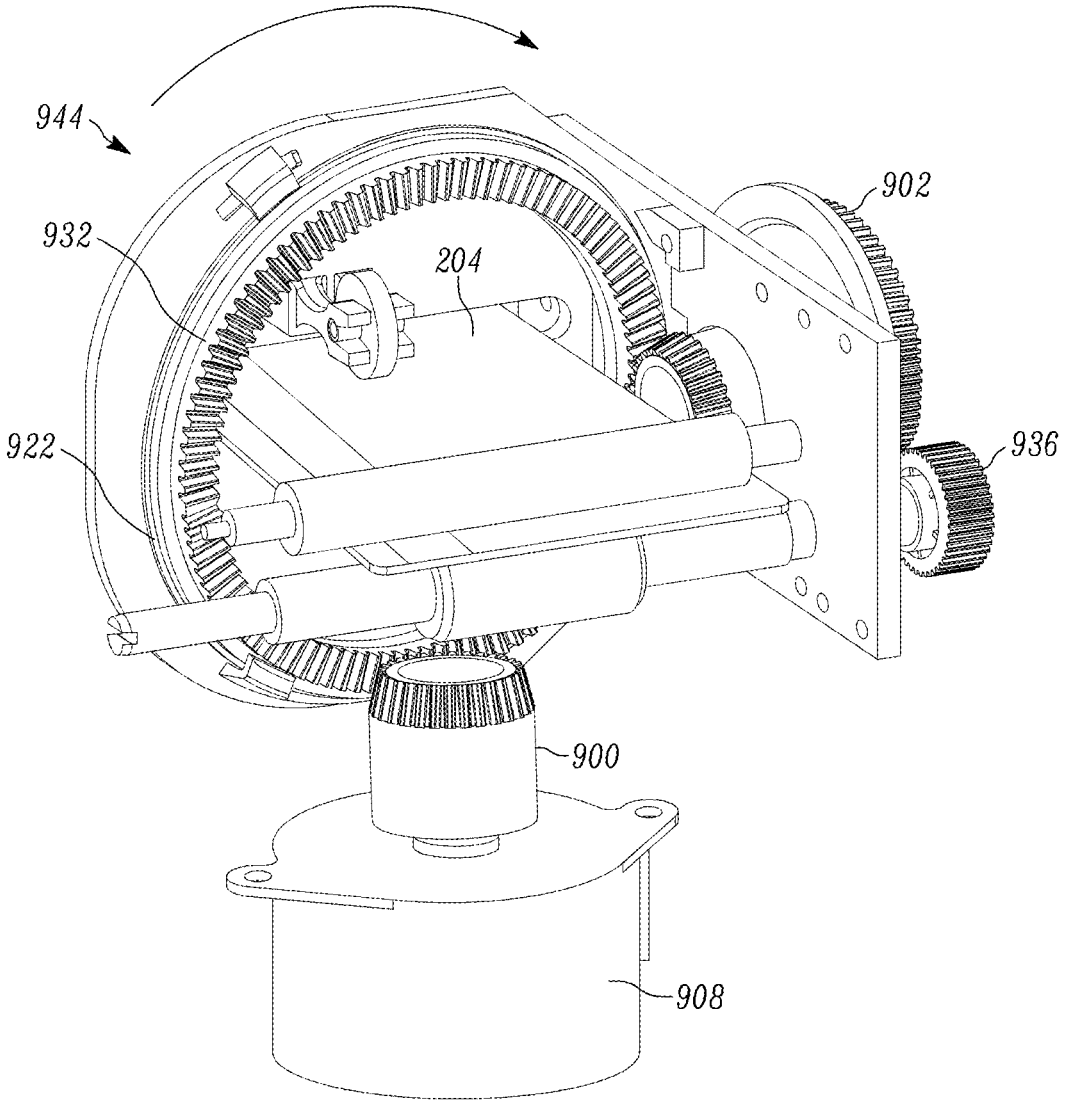

Turning to FIGS. 9A and 9B, a redirector 944 is illustrated according to another example. While the redirector 244 described above flips a media unit in a direction that is coplanar with the direction of travel of the media unit 204, the example redirector 944 of FIGS. 9A and 9B flips the media unit 204 in a direction that is perpendicular to the direction of travel of the media unit 204. The redirector 944 of FIGS. 9A and 9B includes an output shaft 900 driven by a motor 908, and connected to a selector 932, which in turn is connected to a roller 920 mounted on a shaft 922 rotatable within a carriage 904 of the redirector 944. The selector 932 includes a bevel gear mounted to the carriage 904 on a friction clutch. The bevel gear is connected to the roller 920 via a combination bevel and spur gear 902 and a drive wheel 936 in the form of a gear fixed to the shaft 922.

The redirector 944 receives the media unit 204 into engagement with the roller 920 and a nip roller 921, and the motor 908 is controlled to drive the selector 932 in a counterclockwise direction to drive the media unit 204 into the carriage 904. The carriage 904, in the position shown in FIG. 9A, may abut a stop on the housing 300. When the above-mentioned controller detects that the media unit 204 has been fully received within the carriage 904, the controller operates the motor 908 to drive the selector 932 in the clockwise direction, until the carriage 904 reaches the position shown in FIG. 9B. For example, the housing 300 may include a further stop (not shown) protruding toward the carriage 904 to prevent further rotation of the carriage 904. Having impacted the above-mentioned stop, continued operation of the motor 908 to drive the selector 932 in the clockwise direction overcomes the friction between the bevel gear and the carriage 904, and drives the roller 920 to expel the media unit 204 from the redirector 944.

Figure 10A:
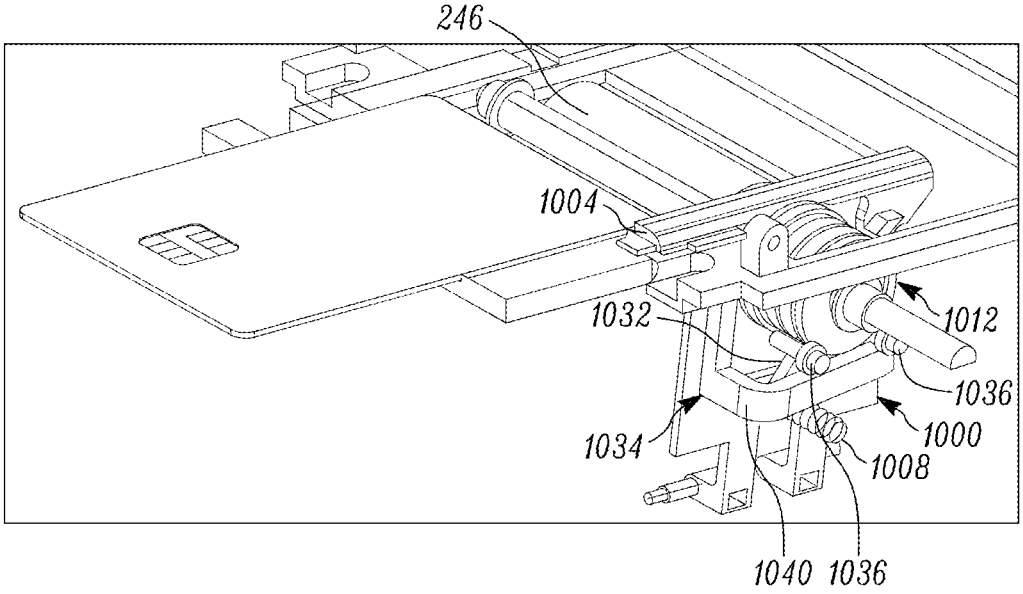
FIGS. 10A-10B depict a registration assembly of the media processing device of FIG. 1.
Figure 10B:
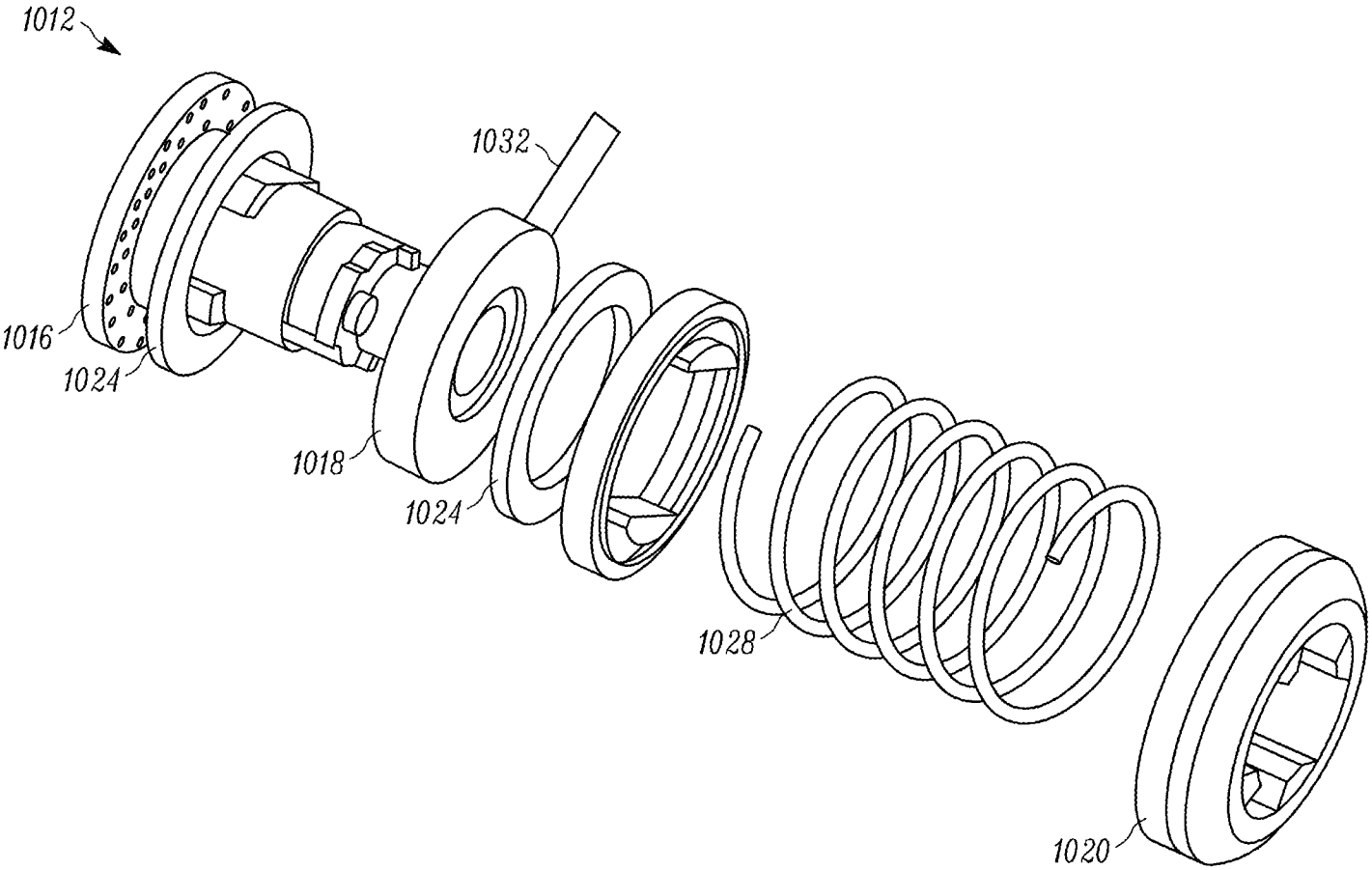

Referring to FIGS. 10A and 10B, the drive roller 246 is illustrated along with a registration assembly 1000. As noted earlier, one or both of the drive rollers 246 and 247 can cooperate with registration assemblies such as the assembly 1000 described below. As the media unit 204 travels over the drive roller 246 toward the redirector 244 in the outbound direction, the registration assembly 1000 is configured to align the edges of the media unit 204 with the direction of travel along the media processing path 216 to prevent the media unit 204 from jamming during the rotation of the redirector 244. Further, the registration assembly 1000 is configured to retract from the media processing path 216 as the media unit 204 exits the redirector 244, to avoid buckling or other damage to the media unit 204 that may cause the media unit 204 to leave the media processing path 216.

The registration assembly includes a registration surface 1004 substantially parallel with a direction of travel of the media unit 204 along the media processing path 216, and a bias member 1008, such as a spring, connected between the housing 104 (not shown) and the registration surface 1004 for biasing the registration surface 1004 toward the media processing path 216 (that is, toward the media unit 204, when the media unit 204 travels over the roller 246). The registration surface 1004 therefore, under the effect of the bias member 1008, applies a force to an edge of the media unit 204 that is substantially perpendicular to the direction of travel of the media unit 204.

The registration assembly also includes an activator 1012 coupled to the drive roller 246. In particular, the activator 1012 includes an outer cap 1016 fixed to an end of the drive roller 246. The activator 1012 is configured to move the registration surface 1004 toward the media processing path 216 into an active position (e.g., for engaging the media unit 204 as described above) responsive to rotation of the roller 246 in a first direction. The first direction, in the present example, is clockwise as shown in FIG. 10A, for driving the media unit 204 toward the redirector 244. Further, the activator 1012 is configured to move the registration surface 1004 away from the media processing path 216 into an inactive position responsive to rotation of the roller 246 in a second direction. In other words, when the media unit 204 exits the redirector 244 and is driven in the return direction by the drive roller 246, the registration surface, via the action of the activator 1012, is withdrawn from the media processing path so as to not obstruct the travel of the media unit 204.

Referring to FIG. 10B, the activator 1012 includes the above-mentioned outer cap 1016, as well as a disc 1018 rotatably mounted between the outer cap 1016 and an inner cap 1020. The disc 1018 is rotatable relative to the caps 1016 and 1020, but is also frictionally engaged with the caps 1016 and 1020 via a pair of friction discs (e.g. felt discs) 1024 pressed against the disc 1018 by a bias member 1028 such as a coil spring. Accordingly, in the absence of an external force acting on the disc 1018 differentially from the remainder of the activator 1012, the disc 1018 rotates with the caps 1016 and 1020 (and therefore with the roller 246). However, the presence of sufficient resistance permits the disc 1018 to rotate relative to the caps 1016 and 1020, and therefore relative to the roller 246. As seen in FIG. 10B, the disc includes a radially extending post.

Returning to FIG. 10A, the registration assembly 1000 includes a cage 1034, of which the registration surface 1004 is a component, including a pair of stops 1036 and a guide wall 1040 extending between the stops 1036. The guide wall 1040 is angled relative to the media processing path, such that the guide wall 1040 is closer to the media processing path 216 at the outbound end (i.e. closer to the redirector 244; the right-hand end as illustrated in FIG. 10A) and further form the media processing path 216 at the return end (i.e. the left-hand end as illustrated in FIG. 10A). As seen in FIG. 10A, the post 1032 extends between the guide wall 1040 and the media processing path 216, and is permitted to travel between the stops 1036 as the roller 246 (and therefore the activator 1012) rotates. When the post 1032 strikes one of the stops 1036, the disc 1018 rotates relative to the roller 246.

When the disc 1018 rotates with the caps 1016 and 1020, the post travels along the guide wall and, due to the angle of the guide wall 1040, forces the cage 1034—and therefore the registration surface 1004—toward or away from the media processing path 216.

Variations to the example methods and apparatus described above are contemplated. In some examples, the redirector 244 is configured to receive and expel a media unit 204 in any one of fewer than, or more than, the three positions described above in connection with the stops 500, 504 and 508. In some examples, the redirector housing 300 is provided with additional stops, and the controller is configured (e.g., via input from additional sensors or extensions of the detection arm 704) to detect the position of the redirector 244 relative to such additional stops and to control the motor 308 accordingly. In further examples, the redirector 244 is equipped with an additional one-way clutch between the redirector housing 300 and the carriage 404 (e.g., between the shaft 408 and the carriage 404), permitting the redirector 244 to be rotated to any position in order to receive or expel a media unit 204.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein (e.g., the controller described above configured to control the motor 308). Alternatively, some or all functions (e.g., control functions described above in connection with the controller tasked with controlling the motor 308) could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

What is claimed is:

1. A registration assembly for a media processing device, comprising:

a registration surface substantially parallel with a direction of travel of a media unit along a media processing path defined within a housing of the media processing device;

a bias member coupled between the housing and the registration surface to bias the registration surface toward the media processing path to apply a force to an edge of the media unit when in an active position; and an activator coupled to a roller, the roller to be driven via contact with the media unit, the roller to rotate in a first rotational direction in response to the media unit moving in a first linear direction, the roller to rotate in a second rotational direction opposite the first rotational direction in response to the media unit moving in a second linear direction opposite the first linear direction, the activator configured to:

(i) move the registration surface toward the media processing path into the active position to engage the media unit responsive to rotation of the roller in the first rotational direction; and (ii) move the registration surface away from the media processing path into an inactive position responsive to rotation of the roller in the second rotational direction.

2. The registration assembly of claim 1, further comprising a wall extending between a first stop and a second stop at an angle relative to the media processing path.

3. The registration assembly of claim 2, wherein the activator comprises a post configured to travel along the wall between the first and second stops responsive to rotation of the roller.

4. The registration assembly of claim 3, wherein the post extends radially from a disc frictionally engaged with the roller.

5. The registration assembly of claim 3, further comprising a cage fixed to the registration surface, the cage including the first stop and the second stop.

6. The registration assembly of claim 5, wherein the post extends into the cage.

7. The registration assembly of claim 2, wherein the post is configured to remain stationary relative to the roller when the post contacts the first stop or the second stop.

8. The registration assembly of claim 1, wherein the media unit is a card.

9. A method for registering a card within a media processing path, the method comprising:

driving a media unit in a first linear direction along a roller, thereby rotating the roller in a first rotational direction;

moving a registration assembly towards the media processing path, via a biasing member, in response to the roller rotating in the first rotational direction, wherein the moving of the registration assembly forces the media unit against a border opposite the media unit from the registration assembly;

driving the media unit in a second linear direction along the roller, thereby rotating the roller in a second rotational direction, the second linear direction being opposite the first linear direction and the second rotational direction being opposite the first rotational direction; and moving the registration assembly away from the media processing path in response to the roller rotating in the second rotational direction.

10. The method of claim 9, wherein a post secured to the roller translates the rotation of the roller into the movement of the registration assembly.

11. The method of claim 9, further comprising flipping the media unit.

12. The method of claim 9, wherein moving the registration assembly comprises moving a post along a wall between stops.

13. The method of claim 12, wherein the wall is angled relative to the media processing path.

14. The method of claim 12, wherein the post is coupled to the roller.

15. The method of claim 9, wherein the media unit is a card.

16. The method of claim 9, wherein the surface is parallel to the border.

* * * * *